US010634418B2

(12) United States Patent
Bae et al.

(10) Patent No.: US 10,634,418 B2
(45) Date of Patent: Apr. 28, 2020

(54) REFRIGERATOR

(71) Applicant: Samsung Electronics Co., Ltd., Suwon-si, Gyeonggi-do (KR)

(72) Inventors: Il Sung Bae, Seongnam-si (KR); Joo Hee Song, Yongin-si (KR); Joo Yong Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 32 days.

(21) Appl. No.: 15/835,106

(22) Filed: Dec. 7, 2017

(65) Prior Publication Data

US 2018/0172336 A1 Jun. 21, 2018

(30) Foreign Application Priority Data

Dec. 15, 2016 (KR) ..... 10-2016-0172027

(51) Int. Cl.
*F25D 23/02* (2006.01)
*F25D 17/04* (2006.01)
(Continued)

(52) U.S. Cl.
CPC ..... *F25D 23/023* (2013.01); *F25D 17/062* (2013.01); *F25D 17/067* (2013.01);
(Continued)

(58) Field of Classification Search
CPC .... F25D 23/023; F25D 17/062; F25D 17/067; F25D 17/08; F25D 11/00; F25D 17/045;
(Continued)

(56) References Cited

U.S. PATENT DOCUMENTS 2,822,672 A * 2/1958 Dickson ..... A47F 3/0447 62/125
5,755,108 A * 5/1998 Ibrahim ..... A47F 3/0408 62/256
(Continued)

FOREIGN PATENT DOCUMENTS

JP S4929556 U 3/1974
JP 2002-181435 A 6/2002
(Continued)

OTHER PUBLICATIONS

ISA/KR, "International Search Report," International Application No. PCT/KR2017/014437, dated Apr. 24, 2018, 3 pages.
(Continued)

*Primary Examiner* — Melvin Jones

(57) ABSTRACT

Disclosed herein is a refrigerator which includes a rear duct including a first guide passage configured to guide cold air generated in an evaporator and a cooling discharge port through which the cold air is discharged from the first guide passage to the inside of a storage compartment to cool the storage compartment, an upper duct including a second guide passage coupled with the first guide passage and an air curtain discharge port through which the cold air is discharged from the second guide passage to a front opening of the storage compartment to form an air curtain at the front opening of the storage compartment, and a blade to close or open the air curtain discharge port and which may form an effective air curtain with a simple structure.

20 Claims, 16 Drawing Sheets

(51) Int. Cl.

| | |
|---|---|
| ***F25D 17/06*** | (2006.01) |
| ***F25D 17/08*** | (2006.01) |
| *F25D 11/00* | (2006.01) |

(52) U.S. Cl.
CPC ..... *F25D 17/08* (2013.01); *F25B 2600/112* (2013.01); *F25D 11/00* (2013.01); *F25D 17/045* (2013.01); *F25D 2317/067* (2013.01); *F25D 2317/0665* (2013.01); *F25D 2500/02* (2013.01)

(58) Field of Classification Search
CPC ..... F25D 2317/0665; F25D 2317/067; F25D 2500/02; F25B 2600/112
See application file for complete search history.

(56) References Cited

U.S. PATENT DOCUMENTS

| | | | | |
|---|---|---|---|---|
| 5,809,799 | A | 9/1998 | Jeon | |
| 9,080,807 | B2 * | 7/2015 | Cho | F25D 17/062 |
| 2009/0205351 | A1 * | 8/2009 | Fung | A47F 3/0447 62/256 |
| 2013/0019621 | A1 * | 1/2013 | Wood | A47F 3/0447 62/126 |

FOREIGN PATENT DOCUMENTS

| | | | |
|---|---|---|---|
| JP | 2015-001330 | A | 1/2015 |
| KR | 10-1997-0075770 | A | 12/1997 |
| KR | 10-0164766 | B1 | 9/1998 |
| KR | 10-0305321 | B1 | 7/2001 |
| KR | 10-2008-0029483 | A | 4/2008 |
| KR | 10-2012-01265338 | A | 11/2012 |
| KR | 10-2016-0024508 | A | 3/2016 |
| WO | 2014/198152 | A1 | 12/2014 |

OTHER PUBLICATIONS

Supplementary European Search Report dated Aug. 16, 2019 in connection with European Patent Application No. 17 88 0993, 7 pages.

* cited by examiner

REFRIGERATOR

CROSS-REFERENCE TO RELATED APPLICATION AND CLAIM OF PRIORITY

This application is related to and claims priority to Korean Patent Application No. 10-2016-0172027, filed on Dec. 15, 2016, the contents of which are incorporated herein by reference.

TECHNICAL BACKGROUND

Embodiments of the present disclosure relate to a refrigerator which has an air curtain formed on a front opening of a storage compartment when a door is opened.

BACKGROUND

A refrigerator is a home appliance configured to freshly store food by including a main body including a storage compartment, a cold air supply device provided to supply cold air to the storage compartment, and a door provided to open and close the storage compartment.

Generally, the storage compartment is provided to open a front side thereof so that food is taken in and out, and the open front side of the storage compartment is opened and closed by the door. When the door is opened, the cold air in the storage compartment is discharged to the outside, and warm air outside the storage compartment is introduced into the storage compartment, and thus a temperature of the storage compartment may be increased.

The temperature of the storage compartment should be maintained within a predetermined range to freshly store food, and thus there may be a difficulty in freshly storing food when the temperature of the storage compartment increases, and additional energy may be consumed to drop the temperature of the storage compartment to a normal temperature.

Therefore, when a structure of having an air curtain formed at a front opening of the storage compartment is provided to prevent cold air from being discharged out of the storage compartment and external air from being introduced thereinto when the door is opened, reliability and energy efficiency of the refrigerator may be enhanced.

SUMMARY

To address the above-discussed deficiencies, it is a primary object to provide a refrigerator configured to form an air curtain at a front opening of a storage compartment with a simple structure.

It is an aspect of the present disclosure to provide a refrigerator configured to form an effective air curtain by increasing a discharge amount of cold air discharged to an air curtain discharge port.

Additional aspects of the disclosure will be set forth in part in the description which follows and, in part, will be obvious from the description, or may be learned by practice of the disclosure.

In accordance with one aspect of the present disclosure, a refrigerator includes a main body, a storage compartment formed in the main body and having an open front side, a door provided to open and close the storage compartment, an evaporator provided to generate cold air, a rear duct including a first guide passage configured to guide the cold air generated in the evaporator and a cooling discharge port through which the cold air is discharged from the first guide passage to an inside of the storage compartment to cool the storage compartment, an upper duct including a second guide passage coupled to the first guide passage and an air curtain discharge port through which the cold air is discharged from the second guide passage to a front opening of the storage compartment to form an air curtain at the front opening of the storage compartment, and a blade provided to close or open the air curtain discharge port.

The refrigerator may further include a blower fan configured to suck the cold air generated in the evaporator, to discharge the cold air through the cooling discharge port when the air curtain discharge port is closed, and to discharge the cold air through the air curtain discharge port when the air curtain discharge port is opened.

The blower fan may rotate at a first speed in a storage compartment cooling mode in which the blade closes the air curtain discharge port and the blower fan rotates, and the blower fan may rotate at a second speed faster than the first speed in an air curtain mode in which the blade opens the air curtain discharge port and the blower fan rotates.

A cross-sectional area of an outlet of the first guide passage may be greater than a cross-sectional area of an inlet of the first guide passage.

The first guide passage may have a section in which a cross-sectional area increases from an inlet of the first guide passage toward an outlet of the first guide passage.

The rear duct may include a rear cover configured to separate the storage compartment and the first guide passage, and a pair of first guide walls provided to protrude from the rear cover and face each other to form the first guide passage.

A gap between the pair of first guide walls at an outlet of the first guide passage may be greater than a gap between the pair of first guide walls at an inlet of the first guide passage.

The first guide passage may have a section in which a gap between the pair of first guide walls increases from an inlet of the first guide passage toward an outlet of the first guide passage.

A cross-sectional area of an outlet of the second guide passage may be greater than a cross-sectional area of an inlet of the second guide passage.

The second guide passage may have a section in which a cross-sectional area increases from an inlet of the second guide passage toward an outlet of the second guide passage.

The upper duct may include an upper cover configured to separate the storage compartment and the second guide passage, and a pair of second guide walls provided to protrude from the upper cover and face each other to form the second guide passage.

A gap between the pair of second guide walls at an outlet of the second guide passage may be greater than a gap between the pair of second guide walls at an inlet of the second guide passage.

The second guide passage may have a section in which a gap between the pair of second guide walls increases from an inlet of the second guide passage toward an outlet of the second guide passage.

The rear duct and the upper duct may be separately provided, and the rear duct and the upper duct may have couplers provided to be coupled to each other.

The blade may be configured to rotatably guide the cold air discharged through the air curtain discharge port to a rear surface of the door when the door is closed.

In accordance with another aspect of the present disclosure, a refrigerator includes a main body, a storage compartment formed in the main body and having an open front side, a door provided to open and close the storage compartment, an evaporator provided to generate cold air, a guide duct including an air curtain discharge port through which the cold air is discharged to a front opening of the storage compartment to form an air curtain at the front opening of the storage compartment, a cooling discharge port through which the cold air is discharged to the inside of the storage compartment to cool the storage compartment, an air curtain passage configured to guide the cold air generated in the evaporator to the air curtain discharge port, and a cooling passage branched from the air curtain passage to guide the cold air generated in the evaporator to the cooling discharge port, and a blade provided to close or open the air curtain discharge port.

A passage resistance for air moving through the air curtain passage may be less than a passage resistance for air moving through of the cooing passage.

The guide duct may include a rear duct including the cooling discharge port and coupled to a rear surface of the storage compartment, and an upper duct including an air curtain discharge port and coupled to an upper surface of the storage compartment.

In accordance with still another aspect of the present disclosure, a refrigerator includes a main body, a storage compartment formed in the main body and having an open front side, a door provided to close and open the storage compartment, an evaporator provided to generate cold air, a guide duct including a guide passage configured to guide the cold air generated in the evaporator, an air curtain discharge port through which the cold air is discharged from the guide passage to a front opening of the storage compartment to form an air curtain at the front opening of the storage compartment, a cooling discharge port through which the cold air is discharged from the guide passage to the inside of the storage compartment to cool the storage compartment, a cover configured to separate the storage compartment and the guide passage, and a partition configured to protrude from the cover so that the cold air introduced into the guide passage moves toward the cooling discharge port, and a blade provided to close or open the air curtain discharge port.

A plurality of partitions may be provided, the guide passage may be divided into a center, a left side and a right side by the plurality of partitions, and the cooling discharge ports may be provided on the left side and the right side.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 10 is a view showing an operation state in which an air curtain is formed when a door is opened, FIG. 11 is a view showing an operation state in which a storage compartment is cooled when the door is closed, and FIG. 12 is a view showing an operation in which a rear surface of the door is cooled when the door is closed:

FIG. 13 is a view showing an operation state in which an air curtain is formed when a door is opened, and FIG. 14 is a view showing an operation state in which a storage compartment is cooled when the door is closed: FIG. 15 is a view showing an operation state in which an air curtain is formed when a door is opened, and FIG. 16 is a view showing an operation state in which a storage compartment is cooled when the door is closed.

DETAILED DESCRIPTION

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

the embodiments described in this specification are only exemplary embodiments and do not represent the overall technological scope of the present disclosure, it is understood that the present disclosure covers various equivalents, modifications, and substitutions at the time of filing of this application.

Hereinafter, exemplary embodiments of the present disclosure will be described in detail with reference to the accompanying drawings.

Figure 1:
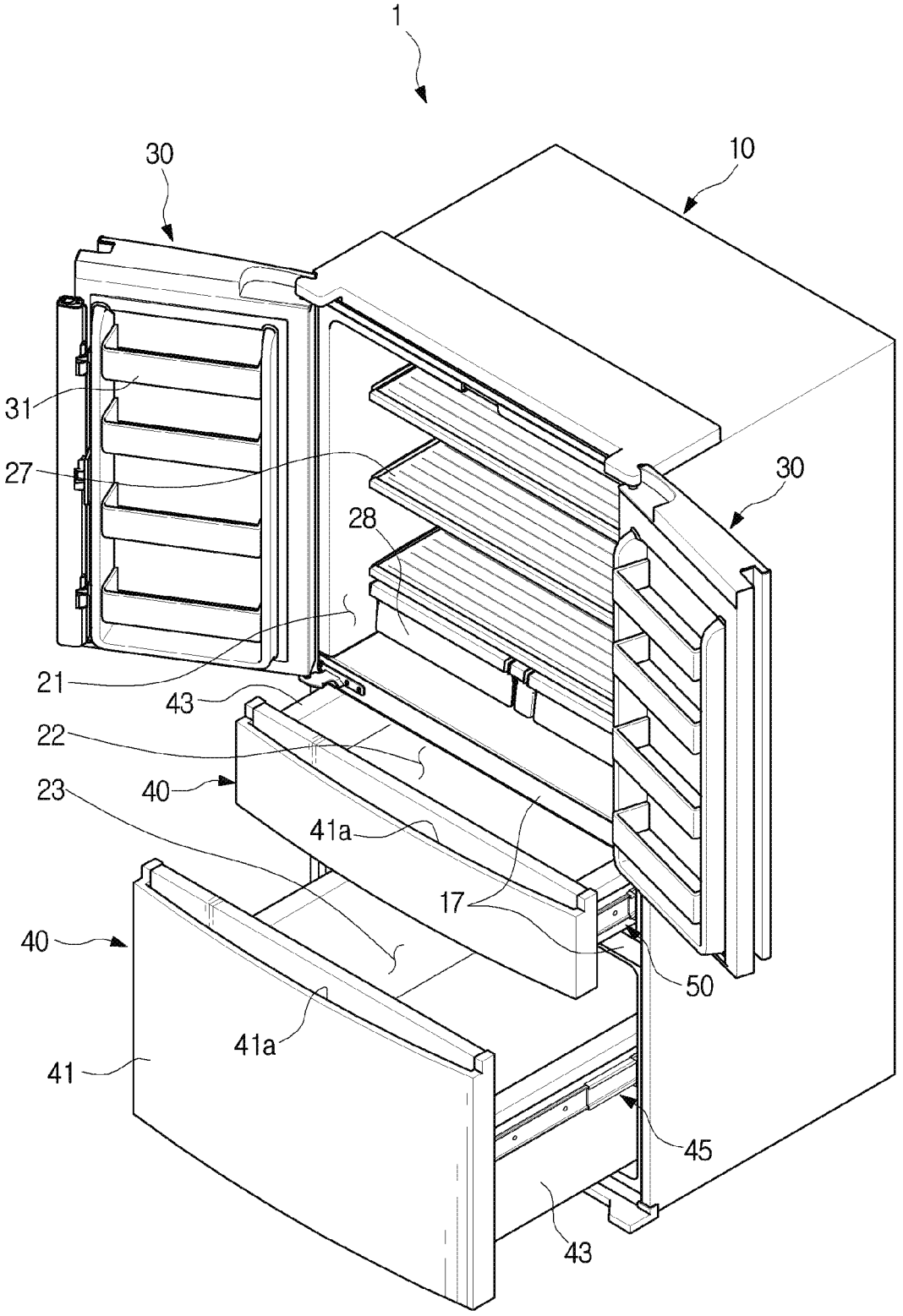
FIG. 1 illustrates a view showing a refrigerator according to one embodiment of the present disclosure.
Figure 2:
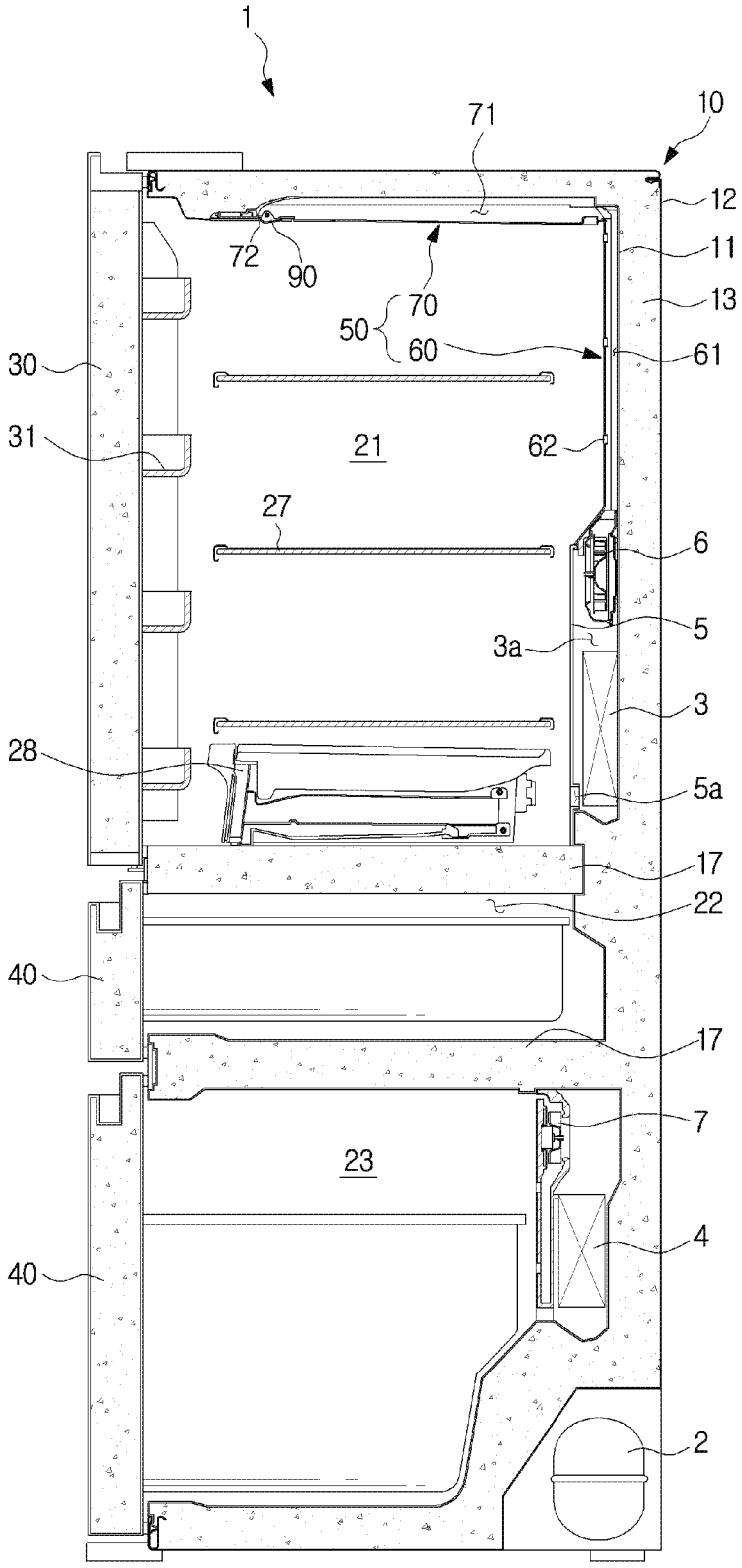
FIG. 2 illustrates a side cross-sectional view schematically showing the refrigerator of FIG. 1.

FIG. 1 is a view showing a refrigerator according to one embodiment of the present disclosure, and FIG. 2 is a side cross-sectional view schematically showing the refrigerator of FIG. 1.

Referring to FIGS. 1 to 2, a refrigerator 1 may include a main body 10 including storage compartments 21, 22 and 23, doors 30 and 40 provided to open and close the storage compartments 21, 22 and 23, and a cold air supply device configured to supply cold air to the storage compartments 21, 22 and 23.

The main body 10 may include an inner case 11 configured to form the storage compartments 21, 22 and 23, an outer case 12 coupled to the outside of the inner case 11, and an insulating material 13 provided between the inner case 11 and the outer case 12. The inner case 11 may be injection-molded and formed of a plastic material, and the outer case 12 may be made of a metal material. A urethane foam insulating material is used as the insulating material 13 or may be used with a vacuum insulation panel as necessary. The main body 10 may include a middle wall 17 to vertically divide the storage compartments 21, 22 and 23.

The storage compartments 21, 22 and 23 may be used as a refrigerating compartment to keep food refrigerated by maintaining a temperature of about 0 to 5° C. and used as a freezing compartment to keep food frozen by maintaining a temperature of about −30 to 0° C.

The storage compartments 21, 22 and 23 are provided so that front sides are opened to allow food to be taken in and out, and the open front sides of the storage compartments 21, 22 and 23 may be opened and closed by the doors 30 and 40. The storage compartments 21, 22 and 23 include a shelf 27 on which food is placed and a storage container 28 in which food is stored.

The door 30 may be coupled to the main body 10 to laterally rotate. A door guard 31 may be provided at a rear surface of the door 30 to store food.

The door 40 may include a door part 41 provided to be slidably inserted into the storage compartments 22 and 23 or slidably withdrawn from the storage compartments 22 and 23 and configured to cover the open front sides of the storage compartments 22 and 23 and a basket 43 coupled to a rear surface of the door part 41. The basket 43 may be supported to be slidable by a rail 45. The door part 41 may include a grip 41*a*.

The cold air supply device may generate cold air using evaporation latent heat of a refrigerant by a cooling cycle. The cold air supply device may include a compressor 2, a condenser, an expansion device, evaporators 3 and 4, and blower fans 6 and 7.

The evaporator 3 may be disposed at a rear of the storage compartment 21 to generate cold air. The evaporator 3 may be accommodated in a cooling compartment 3*a* formed by an evaporator cover 5. The evaporator cover 5 includes a sucking port 5*a* and may suck air from the storage compartment 21 into the cooling compartment 3*a* through the sucking port 5*a*.

The blower fan 6 may be provided in the cooling compartment 3*a* so that air flows. A guide duct 50 may be coupled with the cooling compartment 3*a* to guide the cold air in the cooling compartment 3*a*. Thus, when the blower fan 6 is operated, air may be sucked from the storage compartment 21 into the cooling compartment 3*a* through the sucking port 5*a*, and the sucked air may be cooled through the evaporator 3 and may be guided into the guide duct 50.

The guide duct 50 may include a rear duct 60 provided at the rear of the storage compartment 21 and an upper duct 70 provided at an upper portion of the storage compartment 21.

The rear duct 60 may include a first guide passage 61 configured to guide the cold air generated in the evaporator 3 and a cooling discharge port 62 through which the cold air is discharged from the first guide passage 61 into the storage compartment 21 to cool the storage compartment 21.

The upper duct 70 may include a second guide passage 71 coupled with the first guide passage 61 and an air curtain discharge port 72 through which the cold air is discharged from the second guide passage 71 to a front opening of the storage compartment 21 to form an air curtain at the front opening of the storage compartment 21. When the door 30 is opened, the air curtain may prevent the cold air of the storage compartment 21 from being discharged and prevent warm air outside the storage compartment 21 from being introduced into the storage compartment 21.

The air curtain discharge port 72 may include a blade 90 provided to close and open the air curtain discharge port 72.

Thus, when the blower fan 6 is operated and the blade 90 opens the air curtain discharge port 72, the cold air generated in the evaporator 3 may pass through the first guide passage 61 and second guide passage 71 in order and be discharged downward to the front opening of the storage compartment 21 through the air curtain discharge port 72, and an air curtain may be formed at the front opening of the storage compartment 21.

When the blower fan 6 is operated and the blade 90 closes the air curtain discharge port 72, the cold air generated in the evaporator 3 may be discharged to the inside of the storage compartment 21 through the cooling discharge port 62, and the storage compartment 21 may be cooled.

As described above, the present disclosure may implement both an air curtain and cooling wind for the storage compartment 21 with a simple structure only using the blower fan 6 and the blade 90. Hereinafter, a structure of forming an air curtain of the refrigerator according to one embodiment of the present disclosure will be described in detail.

Figure 3:
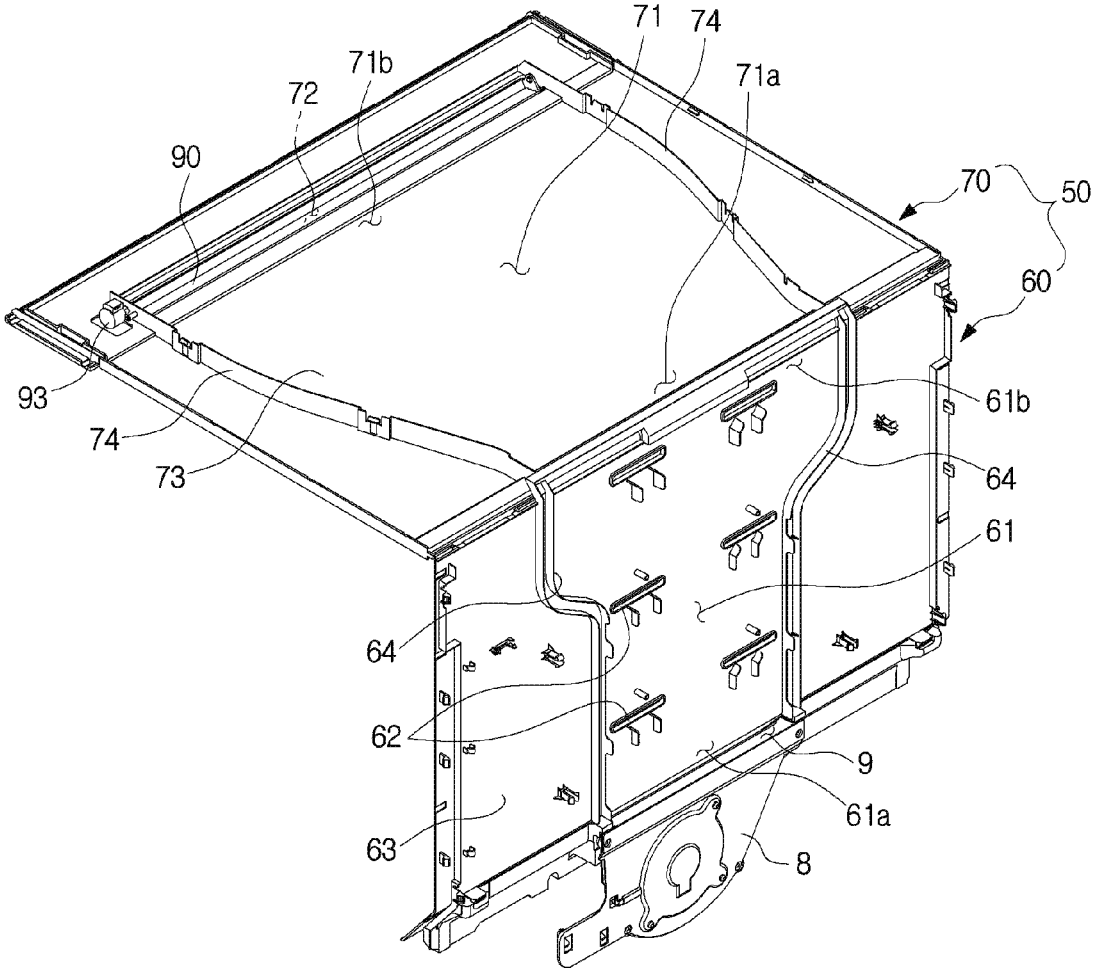
FIG. 3 illustrates a perspective view showing a guide duct of the refrigerator of FIG. 1.
Figure 4:
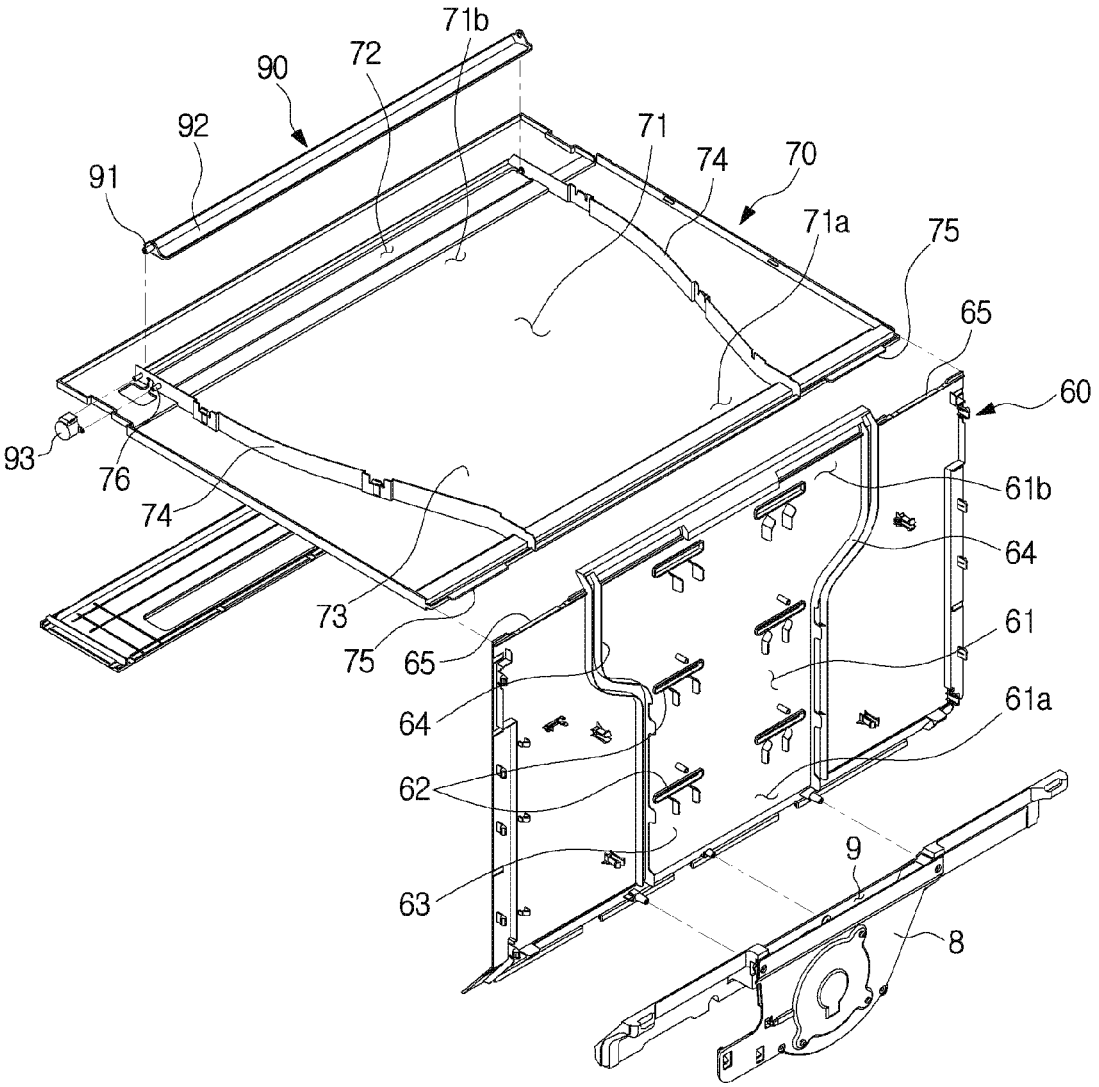
FIG. 4 illustrates a view showing an exploded guide duct of the refrigerator of FIG. 1.
Figure 5:
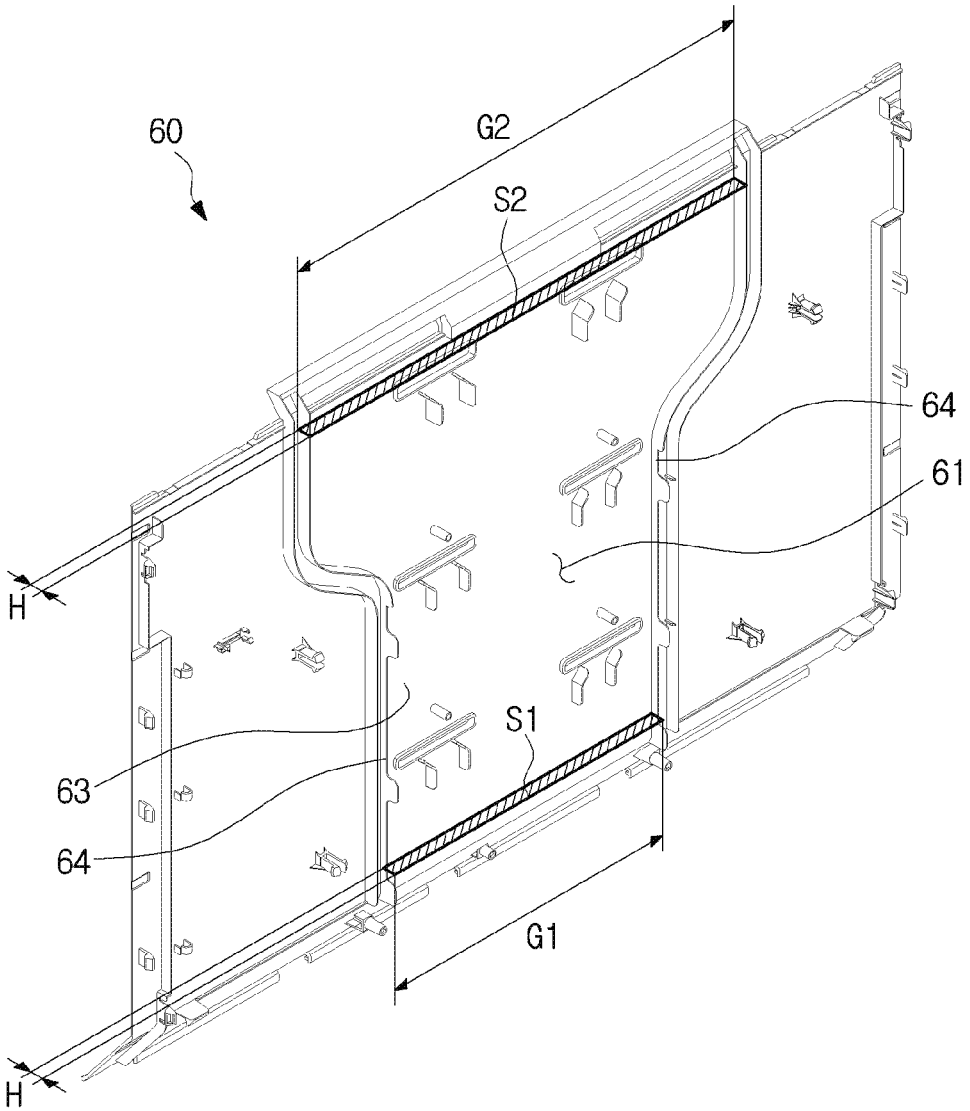
FIGS. 5 and 6 illustrate views showing a rear duct of the refrigerator of FIG. 1.
Figure 6:
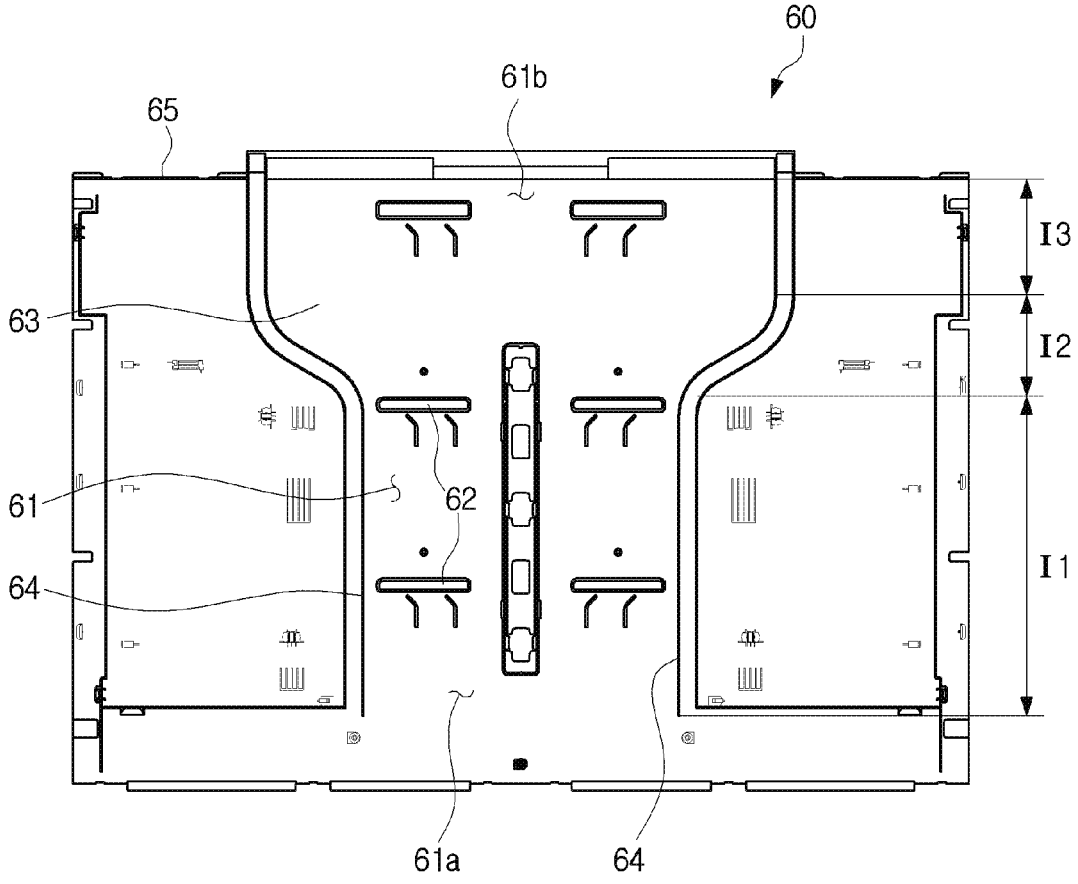
Figure 7:
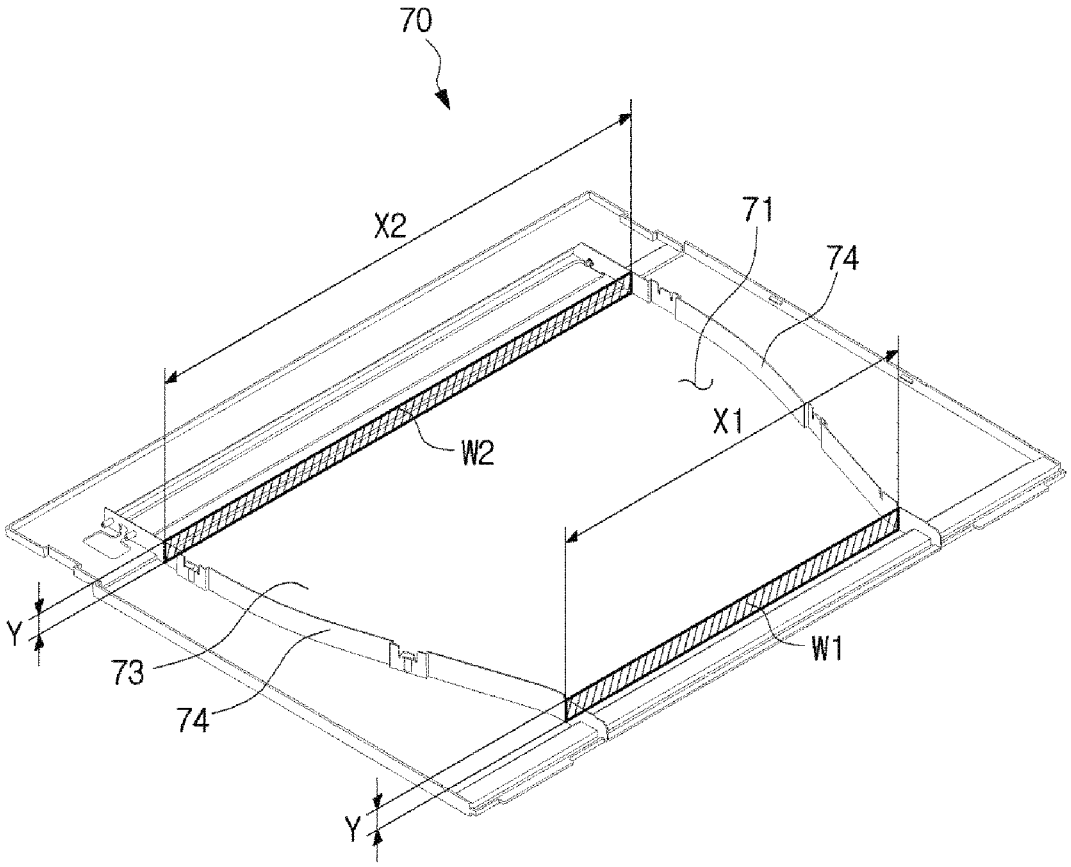
FIGS. 7 and 8 illustrate views showing an upper duct of the refrigerator of FIG. 1.
Figure 8:
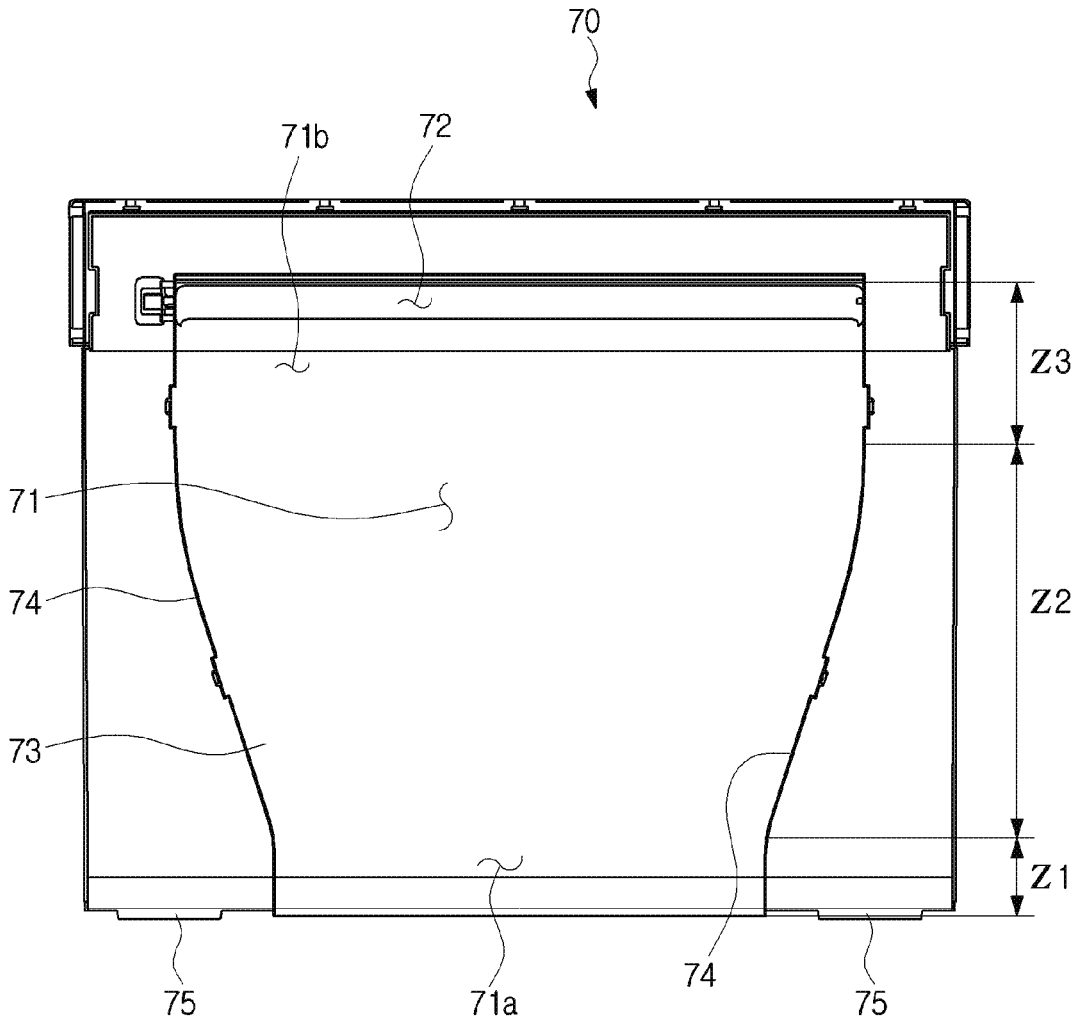

FIG. 3 is a perspective view showing a guide duct of the refrigerator of FIG. 1. FIG. 4 is an exploded view showing the guide duct of the refrigerator of FIG. 1, FIGS. 5 and 6 are views showing a rear duct of the refrigerator of FIG. 1, and FIGS. 7 and 8 are views showing an upper duct of the refrigerator of FIG. 1.

The guide duct 50 may include the rear duct 60 provided at the rear of the storage compartment 21 and the upper duct 70 provided at an upper portion of the storage compartment 21. The rear duct 60 and the upper duct 70 may be integrally formed but, according to one embodiment, the rear duct 60 and the upper duct 70 are separately provided and may be mutually assembled to form the guide duct 50.

The rear duct 60 and the upper duct 70 may include a coupler 65 and a coupler 75 to be coupled to each other, respectively. The couplers 65 and 75 may be provided to be coupled to each other in various coupling structures including various fitting-coupling structures and a coupling structure using a separate fastening member such as a pin, a screw, a bolt, a rivet and the like. Further, the rear duct 60 and the upper duct 70 may be provided to be easily separated from each other.

According to some embodiments, rear duct 60 and the upper duct 70 are provided not to be integrally formed, but to be coupled to and separated from each other, and thus may selectively provide an option of removing an air curtain function by including only the rear duct 60 formed at the refrigerator and an option of adding an air curtain function by including both the rear duct 60 and the upper duct 70 formed at the refrigerator.

The rear duct 60 may include the first guide passage 61 configured to guide the cold air generated in the evaporator 3 and the cooling discharge port 62 through which the cold air is discharged from the first guide passage 61 to the inside of the storage compartment 21 to cool the storage compartment 21. The cold air discharged from an outlet 9 of a blower fan case 8 may be introduced into an inlet 61*a* of the first guide passage 61.

The rear duct 60 may include a rear cover 63 configured to separate the storage compartment 21 and the first guide passage 61 and a pair of first guide walls 64 protruding from the rear cover 63 and provided to face each other to form the first guide passage 61.

The rear duct 60 may be coupled to a rear surface of the storage compartment 21, and the first guide passage 61 may be surrounded by the rear cover 63, the pair of first guide walls 64, and the inner case 11. According to some other embodiments, a separate cover member (not shown) may be additionally provided between the rear duct 60 and the inner case 11 and, in this case, the first guide passage 61 may be surrounded by the rear cover 63, the pair of first guide walls 64, and the cover member (not shown).

According to one embodiment of the present invention, since an opening and closing member configured to open and close the cooling discharge port 62 is not additionally provided, the cooling discharge port 62 is open all the time. The first guide passage 61 with the cooling discharge port 62 and the second guide passage 71 with the air curtain discharge port 72 are coupled to each other, and thus it is preferable that the cold air discharged through the cooling discharge port 62 be minimized when the blower fan 6 is operated while the blade 90 opens the air curtain discharge port 72 to form an air curtain.

To this end, a cross-sectional area S2 of an outlet 61*b* of the first guide passage 61 may be provided to be larger than a cross-sectional area S1 of the inlet 61*a* of the first guide passage 61.

In this case, a passage resistance for air moving through the first guide passage 61 is reduced as compared with a case in which the cross-sectional area S2 of the outlet 61*b* of the first guide passage 61 is provided to be the same as or less than the cross-sectional area S1 of the inlet 61*a* of the first guide passage 61, and the cold air introduced into the inlet 61*a* of the first guide passage 61 may move to the outlet 61*b* of the first guide passage 61 at a faster speed. Therefore, the discharge amount of cold air discharged through the cooling discharge port 62 may be minimized, and the discharge amount of cold air discharged through the air curtain discharge port 72 may be maximized.

In addition, the first guide passage 61 may have a section I2 in which a cross-sectional area increases from the inlet 61*a* of the first guide passage 61 toward the outlet 61*b* of first guide passage 61.

In the embodiment, the first guide passage 61 may have a section I1 in which a cross-sectional area is uniformly maintained from the inlet 61*a* of the first guide passage 61 toward the outlet 61*b* of first guide passage 61, a section I2 in which the cross-sectional area increases, and a section I3 in which the cross-sectional area is uniformly maintained. The section I1, the section I2, and the section I3 may be sequentially formed consecutively.

Unlike the present embodiment of the present disclosure, the cross-sectional area of the first guide passage 61 may be formed to be increased from the inlet 61*a* of the first guide passage 61 toward the outlet 61*b* of first guide passage 61.

When a height H of the first guide passage 61 from the inlet 61*a* of the first guide passage 61 to the outlet 61*b* of first guide passage 61 is uniformly maintained, the cross-sectional area of the first guide passage 61 may be determined by a gap between the pair of first guide walls 64.

That is, a gap G2 between the pair of first guide walls 64 at the outlet 61*b* of the first guide passage 61 may be provided to be greater than a gap G1 between the pair of first guide walls 64 at the inlet 61*a* of the first guide passage 61.

Also, the first guide passage 61 may have the section I2 in which the gap between the pair of first guide walls 64 increases from the inlet 61*a* of the first guide passage 61 toward the outlet 61*b* of the first guide passage 61.

The upper duct 70 may include the second guide passage 71 coupled with the first guide passage 61 and the air curtain discharge port 72 configured to discharge the cold air downward to the front opening of the storage compartment 21 from the second guide passage 71 to form an air curtain at the front opening of the storage compartment 21.

The outlet 61*b* of the first guide passage 61 and an inlet 71*a* of the second guide passage 71 may be provided to be coupled with each other, and the air curtain discharge port 72 may be provided to be adjacent to an outlet 71*b* of the second guide passage.

The upper duct 70 may include an upper cover 73 configured to separate the storage compartment 21 and the second guide passage 71 and a pair of second guide walls 74 provided to protrude from the upper cover 73 and face each other to form the second guide passage 71.

The upper duct 70 may be coupled to the upper surface of the storage compartment 21, and the second guide passage 71 may be surrounded by the upper cover 73, the pair of second guide walls 74, and the inner case 11. Unlike the present embodiment of the present disclosure, a separate cover member (not shown) may be additionally provided between the upper duct 70 and the inner case 11 and, in this case, the second guide passage 71 may be surrounded by the upper cover 73, the pair of second guide walls 74, and the cover member (not shown).

A cross-sectional area W2 of the outlet 71*b* of the second guide passage 71 may be provided to be greater than a cross-sectional area W1 of the inlet 71*a* of the second guide passage 71.

In this case, a passage resistance for air moving through the second guide passage 71 is reduced as compared with a case in which the cross-sectional area W2 of the outlet 71*b* of the second guide passage 71 is the same as or less than the cross-sectional area W1 of the inlet 71*a* of the second guide passage 71, and the cold air introduced into the inlet 71*a* of the second guide passage 71 may move to the outlet 71*b* of the second guide passage 71 at a faster speed.

In addition, the second guide passage 71 may have a section Z2 in which a cross-sectional area increases from the inlet 71*a* of the second guide passage 71 toward the outlet 71*b* of the second guide passage 71.

In the embodiment, the second guide passage 71 may have a section Z1 in which a cross-sectional area is uniformly maintained from the inlet 71*a* of the second guide passage 71 toward the outlet 71*b* of the second guide passage 71, the section Z2 in which the cross-sectional area increases, and a section Z3 in which the cross-sectional area is uniformly maintained. The section Z1, the section Z2, and the section Z3 may be sequentially formed consecutively.

Unlike the present embodiment of the present disclosure, the cross-sectional area of the second guide passage 71 may be formed to increase from the inlet 71*a* of the second guide passage 71 toward the outlet 71*b* of the second guide passage 71.

When a height Y of the second guide passage 71 from the inlet 71*a* of the second guide passage 71 to the outlet 71*b* of the second guide passage 71 is uniformly maintained, the cross-sectional area of the second guide passage 71 may be determined by a gap between the pair of second guide walls 74.

That is, a gap X2 between the pair of second guide walls 74 at the outlet 71*b* of the second guide passage 71 may be provided to be greater than a gap X1 between the pair of second guide walls 74 at the inlet 71*a* of the second guide passage 71.

In addition, the second guide passage 71 may have a section Z2 in which a gap between the pair of second guide walls 74 increases from the inlet 71*a* of the second guide passage 71 toward the outlet 71*b* of the second guide passage 71.

Also, the cross-sectional area W1 of the inlet 71*a* of the second guide passage 71 may be the same as or greater than the cross-sectional area S2 of the outlet 61*b* of the first guide passage 61. Consequently, the cross-sectional area W2 of the outlet 71*b* of the second guide passage 71 may be less than the cross-sectional area S1 of the inlet 61*a* of the first guide passage 61.

The blade 90 may be rotatably coupled to the air curtain discharge port 72 to open and close the air curtain discharge port 72. The blade 90 includes a blade body 92 and a rotating shaft 91, and the rotating shaft 91 may be connected to a motor 93 to receive rotating force. A motor mounting part 76 to which the motor 93 is coupled may be provided in the upper duct 70.

Figure 9:
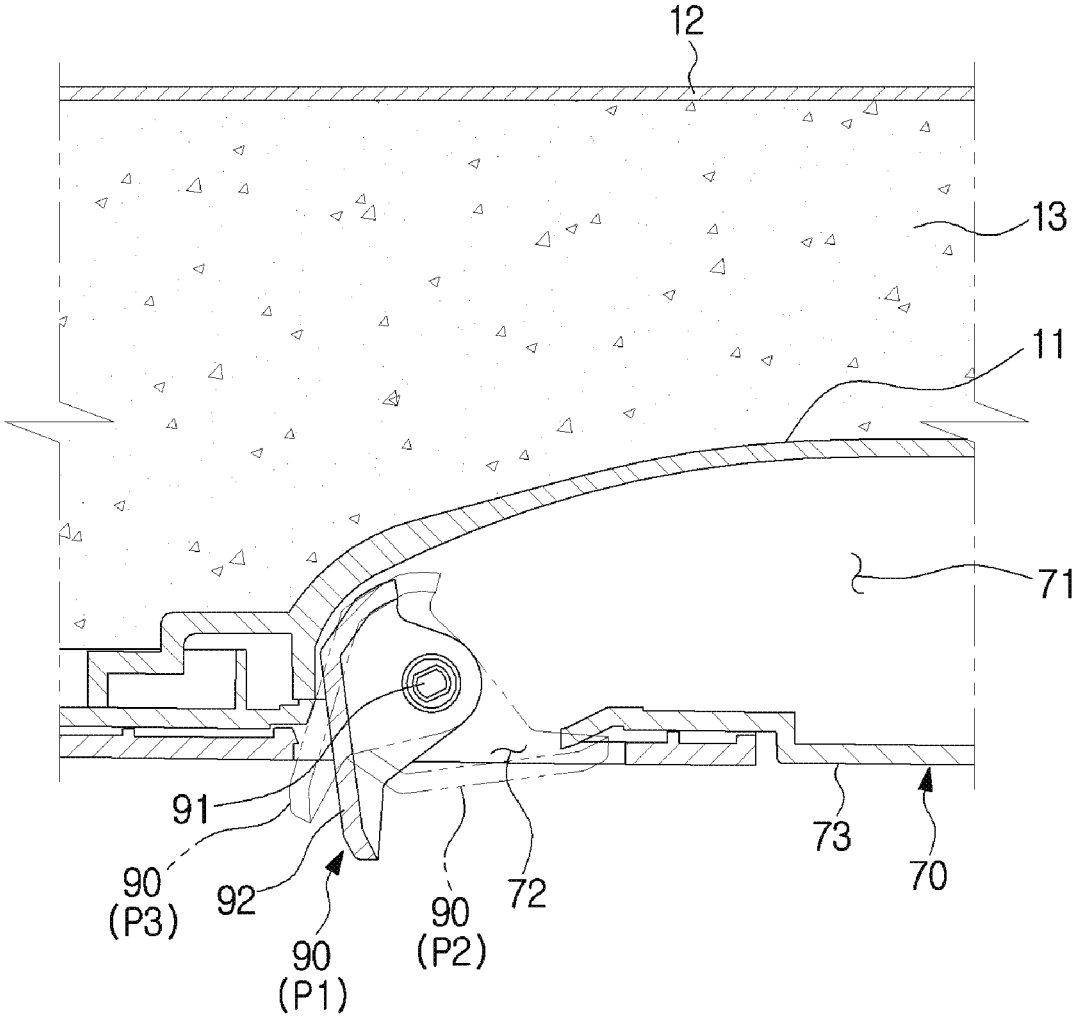
FIG. 9 illustrates a view showing an operation of a blade of the refrigerator of FIG. 1.
Figure 10:
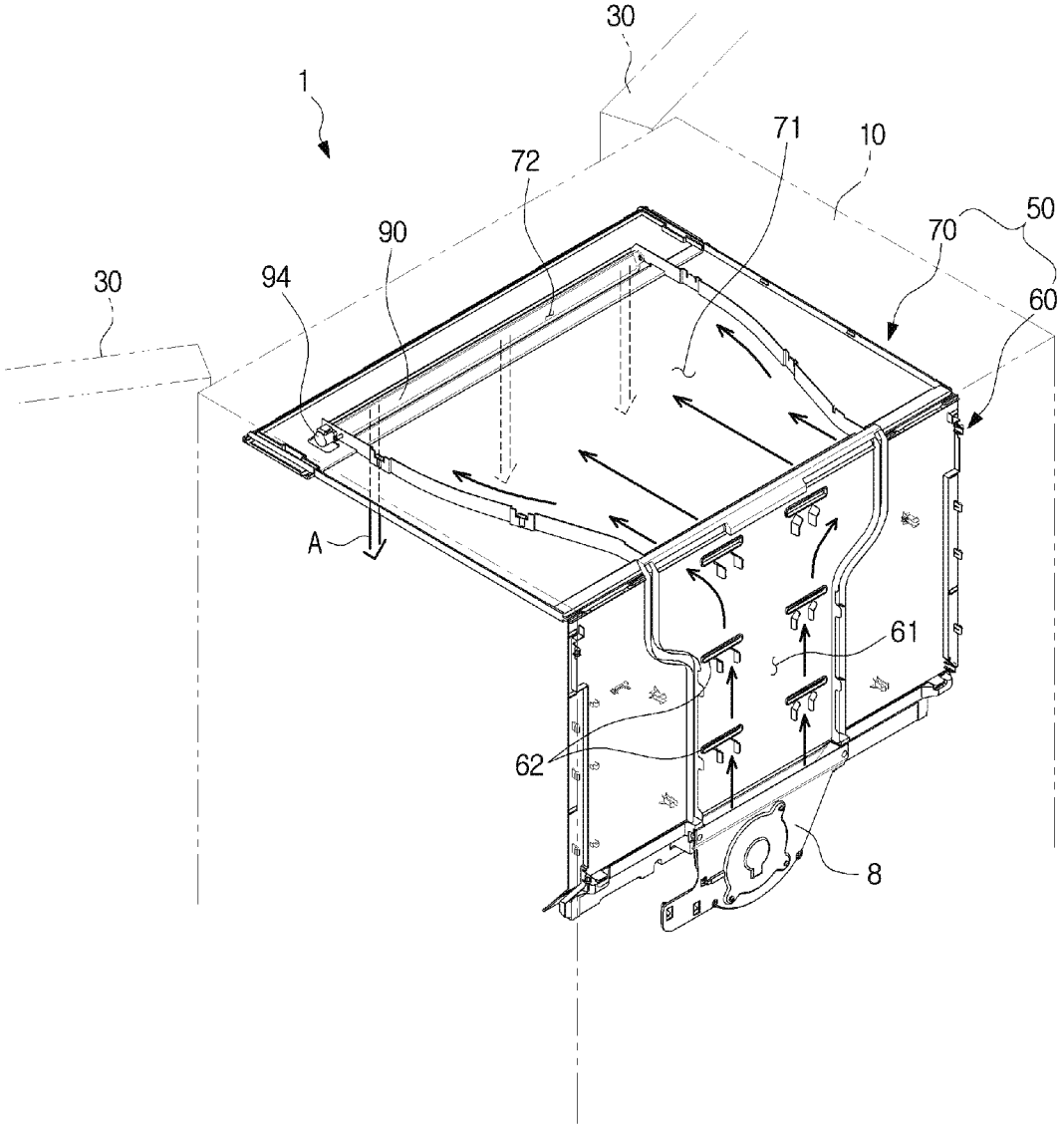
FIGS. 10 to 12 are views showing an operation state of the refrigerator of FIG. 1.
Figure 11:
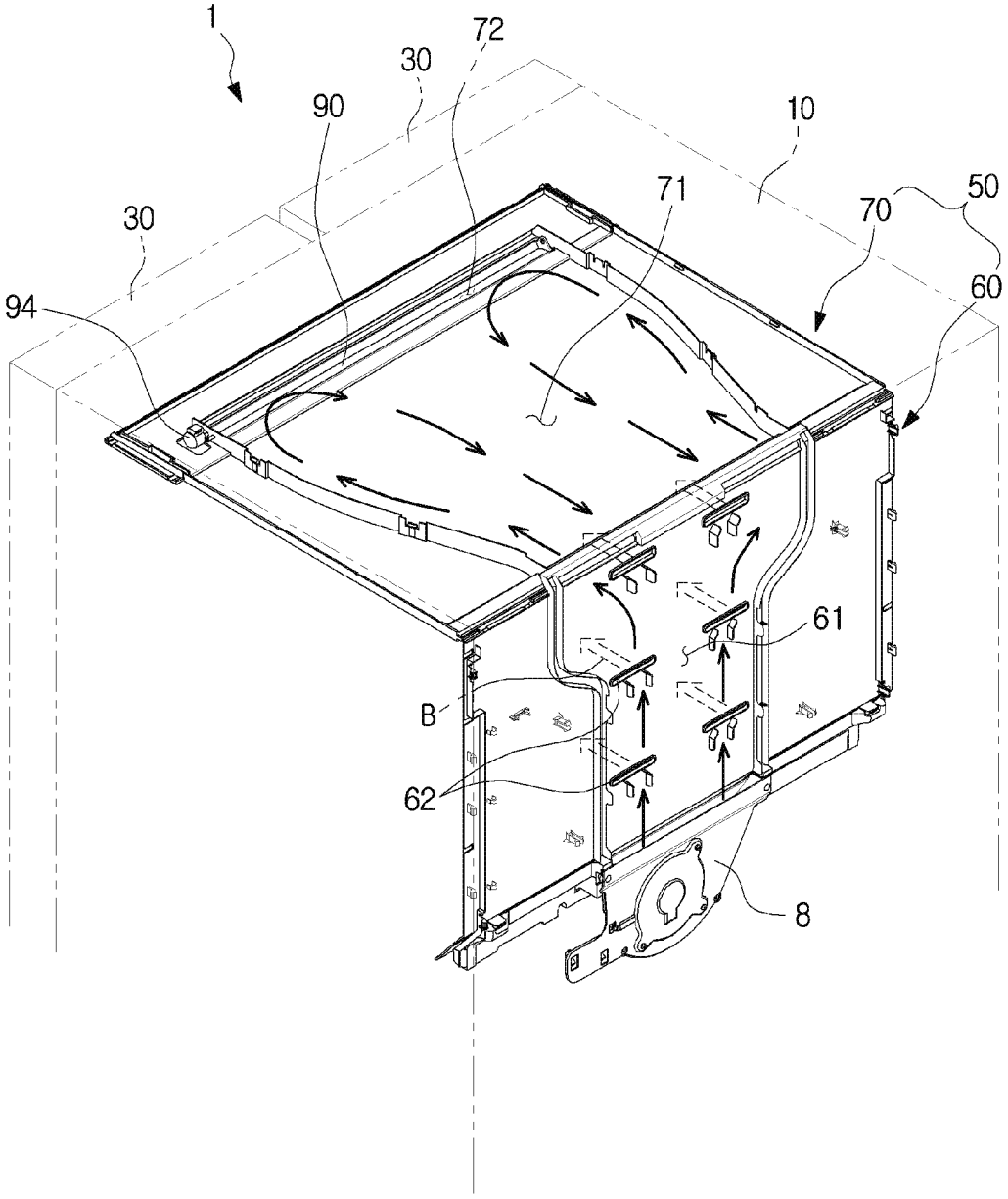
Figure 12:
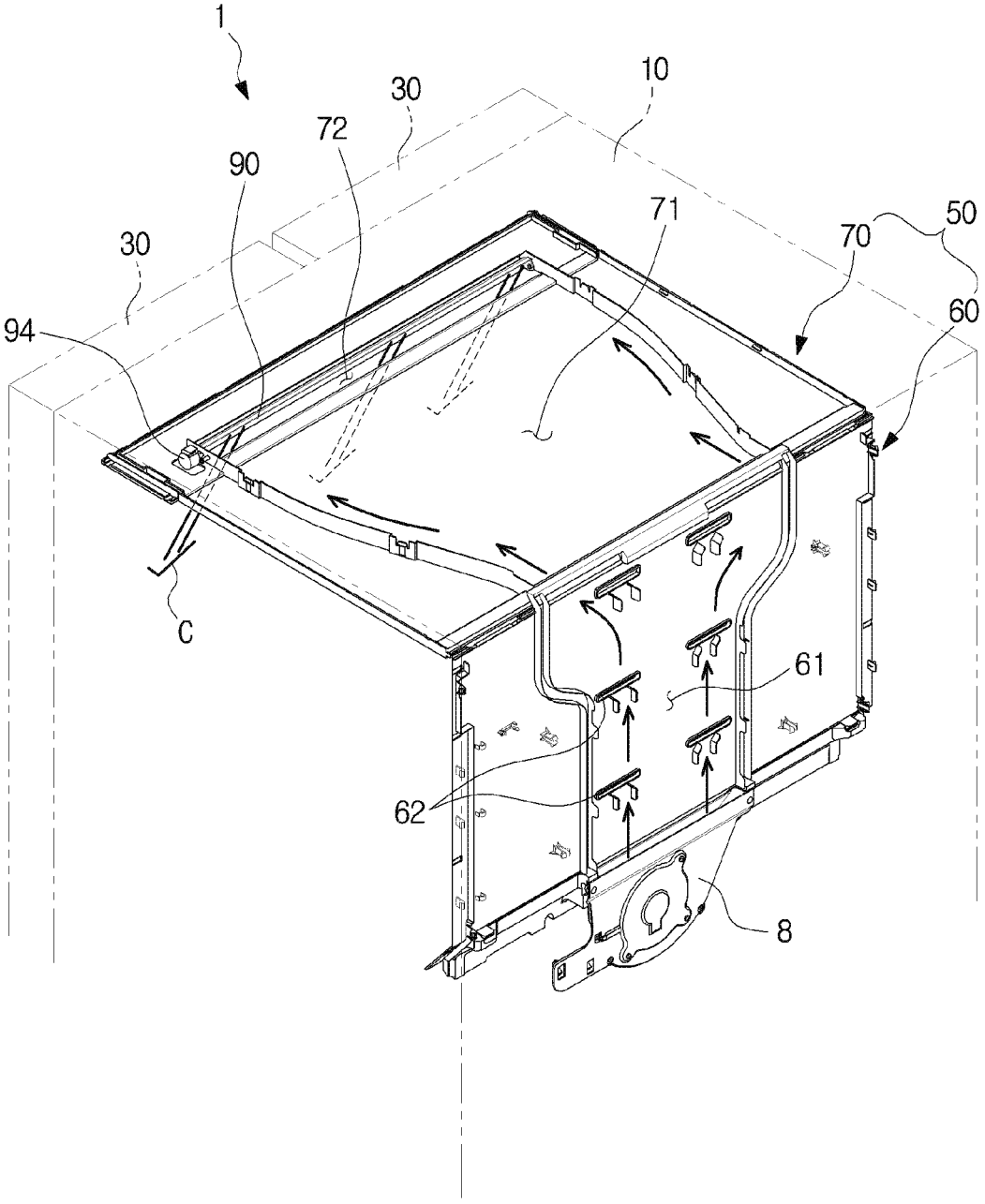

FIG. 9 is a view showing an operation of a blade of the refrigerator of FIG. 1, and FIGS. 10 to 12 are views showing an operation state of the refrigerator of FIG. 1. FIG. 10 is a view showing an operation state in which an air curtain is formed when a door is opened, FIG. 11 is a view showing an operation state in which a storage compartment is cooled when the door is closed, and FIG. 12 is a view showing an operation of cooling a rear surface of the door when the door is closed.

Referring to FIGS. 9 to 12, an operation state of the refrigerator according to one embodiment of the present disclosure will be described.

As shown in FIG. 9, the blade 90 may be rotated between a first position P1 for forming an air curtain by opening the air curtain discharge port 72 when the door 30 is opened and a second position P2 for cooling the storage compartment 21 by closing the air curtain discharge port 72 when the door 30 is closed.

Further, the blade 90 may be provided to rotate to a third position P3 for cooling the rear surface of the door 30 by discharging the cold air discharged through the air curtain discharge port 72 to be inclined toward the rear surface of the door 30 when the door 30 is closed.

As shown in FIG. 10, when the blade 90 is positioned in the first position P and the blower fan 6 rotates, the cold air cooled in the cooling compartment 3*a* by the evaporator 3 passes through the first guide passage 61 and the second guide passage 71 and is discharged downward through the air curtain discharge port 72 to form an air curtain A at the front opening of the storage compartment 21.

In this case, a rotation speed of the blower fan 6 may be made faster than when the storage compartment 21 is cooled in order to increase the discharge amount of cold air discharged through the air curtain discharge port 72 by minimizing the discharge amount of cold air discharged through the cooling discharge port 62.

That is, the blower fan 6 may be configured to rotate at a first speed in a storage compartment cooling mode in which the blade 90 closes the air curtain discharge port 72 and the blower fan 6 rotates, and may be configured to rotate at a second speed faster than the first speed in an air curtain mode in which the blade 90 opens the air curtain discharge port 72 and the blower fan 6 rotates.

As shown in FIG. 11, when the blade 90 is in the second position P2 in which the blade 90 closes the air curtain discharge port 72 and the blower fan 6 rotates, the cold air cooled in the cooling compartment 3*a* by the evaporator 3 is discharged (B) to the inside of the storage compartment 21 from the first guide passage 61 through the cooling discharge port 62 to cool the storage compartment 21.

As shown in FIG. 12, when the blade 90 is in the third position P3 and the blower fan 6 rotates, the cold air cooled in the cooling compartment 3*a* by the evaporator 3 passes through the first guide passage 61 and the second guide passage 71 and is discharged (C) forward to be inclined through the air curtain discharge port 72 to cool the rear surface of the door 30.

Figure 13:
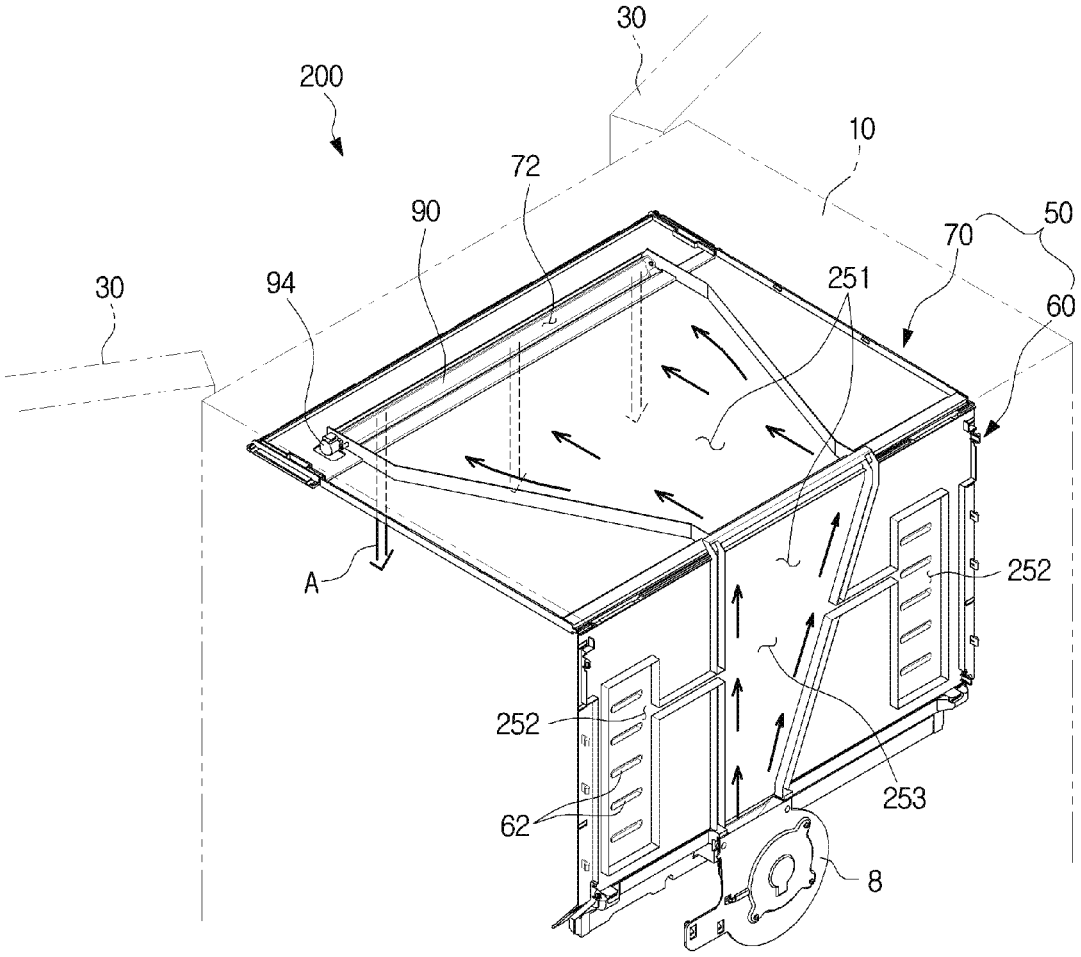
FIGS. 13 and 14 are views showing an operation state of a refrigerator of another embodiment of the present disclosure.
Figure 14:
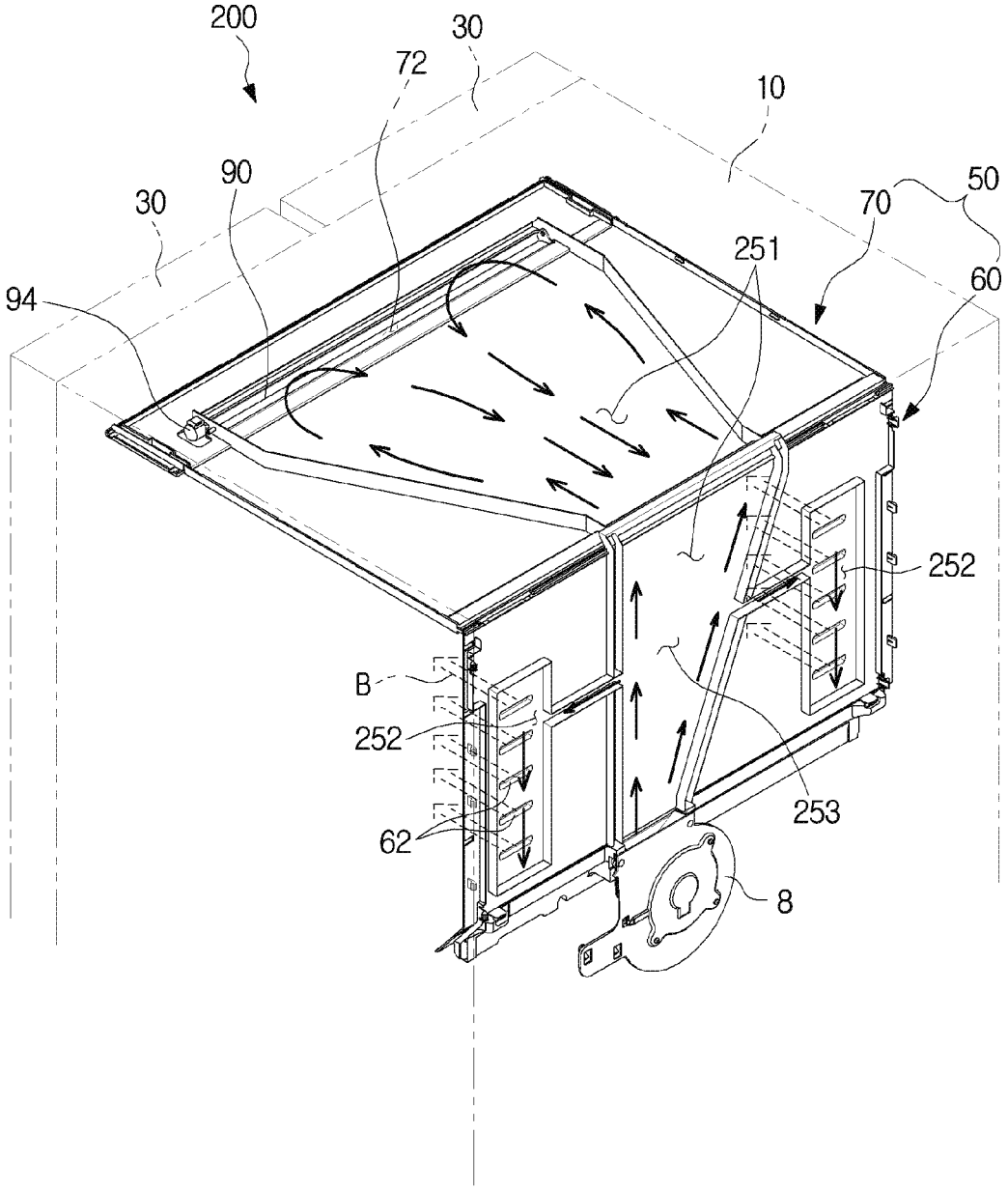

FIGS. 13 and 14 are views showing an operation state of a refrigerator of another embodiment of the present disclosure. FIG. 13 is a view showing an operation state in which an air curtain is formed when a door is opened and FIG. 14 is a view showing an operation state in which a storage compartment is cooled when the door is closed.

A refrigerator 200 according to another embodiment of the present disclosure will be described with reference to FIGS. 13 and 14. The same reference numerals refer to the same elements as those of the above described embodiment, and a description of the same configurations as the above described embodiment will be omitted.

A guide duct 50 may include a rear duct 60 provided at a rear of a storage compartment 21 and an upper duct 70 provided at an upper portion of the storage compartment 21. The rear duct 60 may include a cooling discharge port 62 through which cold air is discharged into the storage compartment 21 to cool the storage compartment 21. The upper duct 70 may include an air curtain discharge port 72 through which the cold air is discharged downward to a front opening of the storage compartment 21 to form an air curtain at the front opening of the storage compartment 21.

The guide duct 50 may include an air curtain passage 251 configured to guide cold air generated in an evaporator 3 to the air curtain discharge port 72 and a cooling passage 252 branched from the air curtain passage 251 to guide the cold air generated in the evaporator 3 to the cooling discharge port 62.

The air curtain passage 251 may be formed in the rear duct 60 and the upper duct 70. The cooling passage 252 may be formed in the rear duct 60. The cooling passages 252 may be formed on the left and right sides of the air curtain passage 251.

A passage resistance for air moving through the air curtain passage 251 may be provided to be less than a passage resistance for air moving through the cooling passage 252. For example, the cross-sectional area of the air curtain passage 251 may be provided to be larger than the cross-sectional area of the cooling passage 252 at a branched point 253 of the air curtain passage 251 and the cooling passage 252.

Therefore, in an air curtain mode in which the blade 90 closes the air curtain discharge port 72 and the blower fan 6 is operated, the discharge amount of cold air discharged to the cooling discharge port 62 is more reduced, and the discharge amount of cold air discharged to the air curtain discharge port 72 may be more increased.

Figure 15:
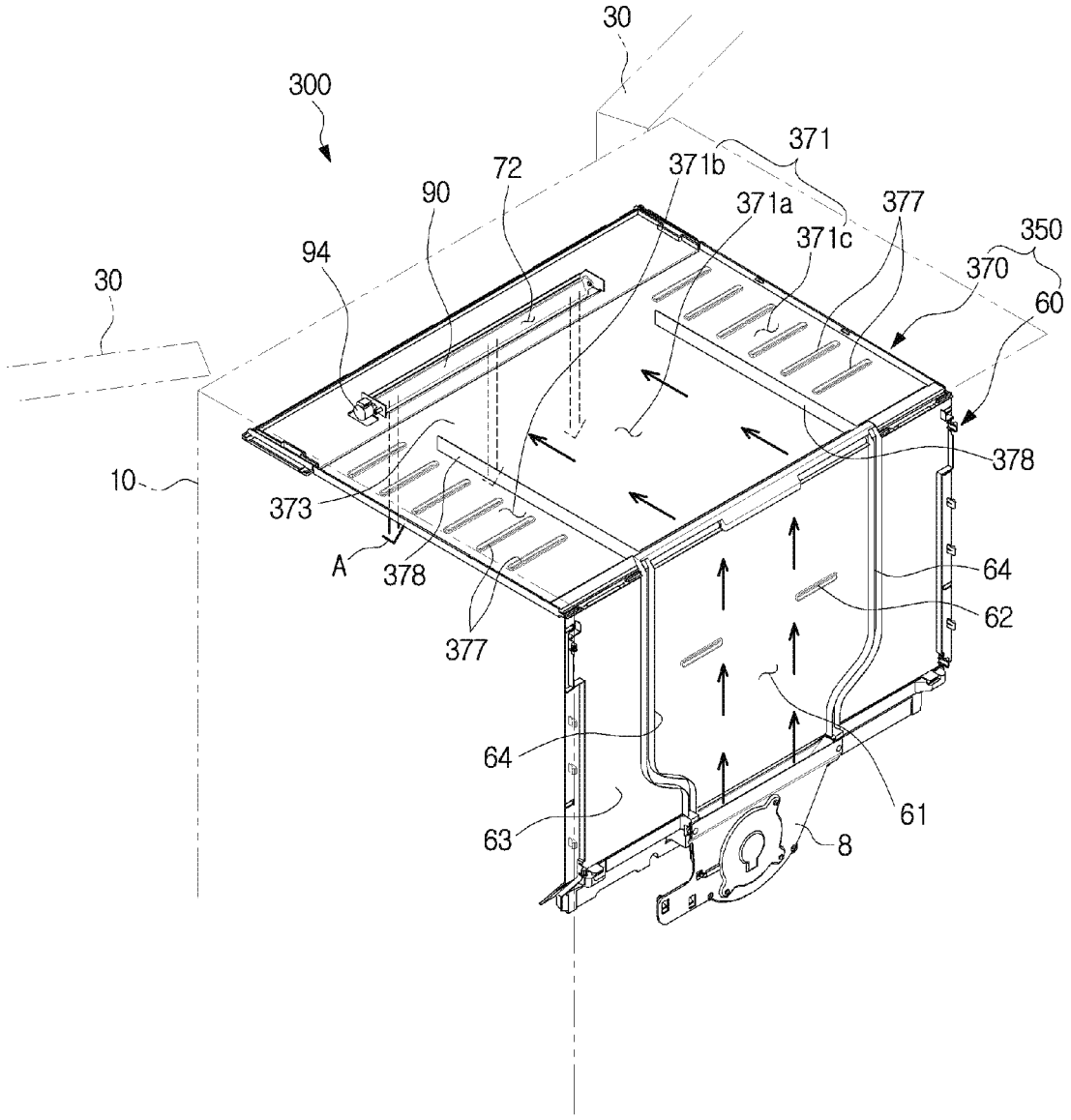
FIGS. 15 and 16 are views showing an operation state of a refrigerator of still another embodiment of the present disclosure.
Figure 16:
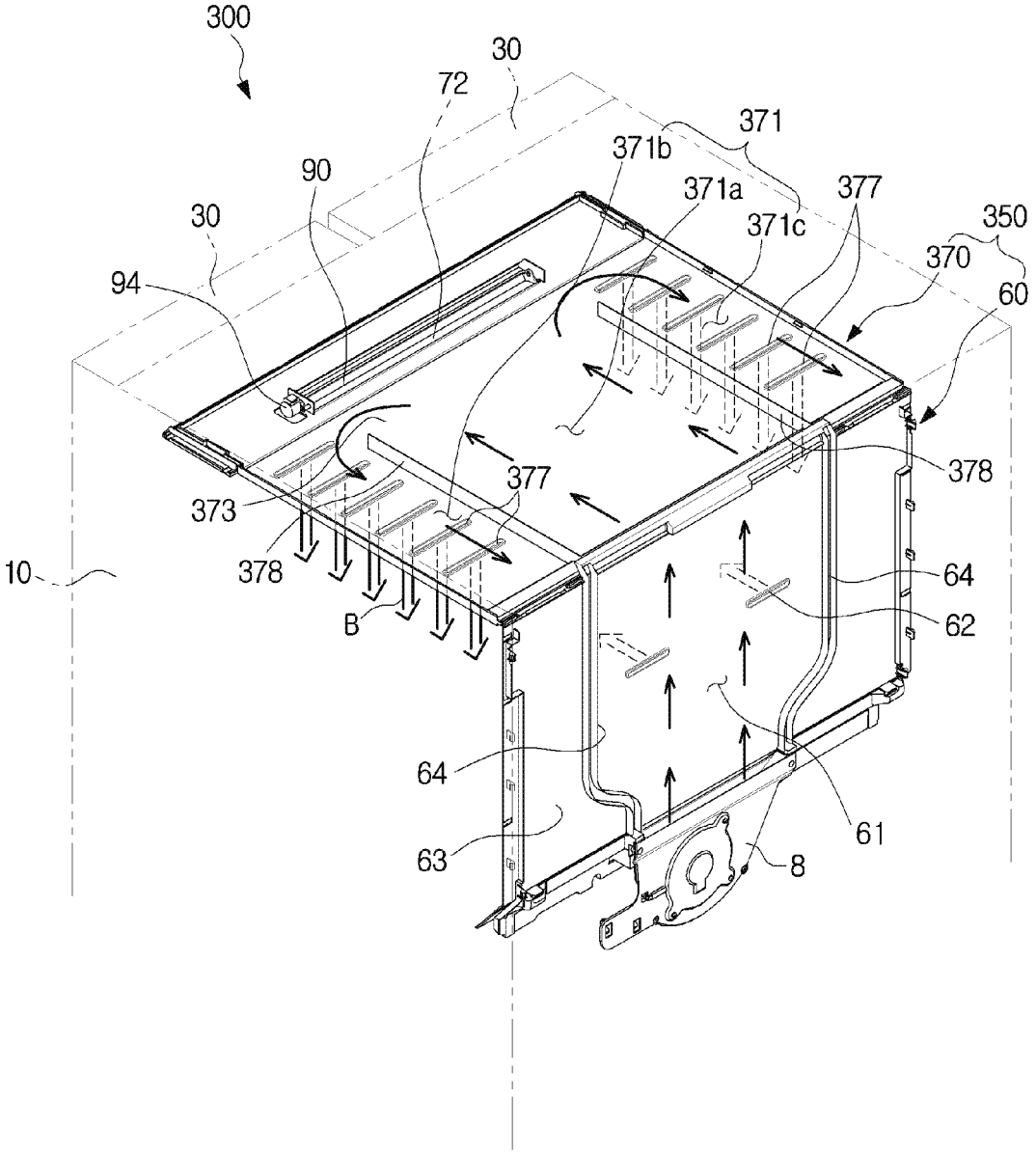

FIGS. 15 and 16 are views showing an operation state of a refrigerator of still another embodiment of the present disclosure. FIG. 15 is a view showing an operation state in which an air curtain is formed when a door is opened and FIG. 16 is a view showing an operation state in which a storage compartment is cooled when the door is closed.

A refrigerator 300 according to still another embodiment of the present disclosure will be described with reference to FIGS. 13 and 14. The same reference numerals refer to the same elements as those of the above described embodiment, and a description of the same configurations as the above described embodiment will be omitted.

A guide duct 350 may include a rear duct 60 provided at a rear of a storage compartment 21 and an upper duct 370 provided at an upper portion of the storage compartment 21.

The rear duct 60 may include a first guide passage 61 configured to guide cold air generated in an evaporator and a cooling discharge port 62 through which the cold air is discharged from the first guide passage 61 to the inside of the storage compartment 21 to cool the storage compartment 21.

The rear duct 60 may include a rear cover 63 configured to separate the storage compartment 21 and the first guide passage 61 and a pair of first guide walls 64 provided to protrude from the rear cover 63 and to face each other to form the first guide passage 61.

The upper duct 370 may include a second guide passage 371 coupled with the first guide passage 61 and an air curtain discharge port 72 through which the cold air is discharged downward to a front opening of the storage compartment 21 from the second guide passage 371 to form an air curtain at the front opening of the storage compartment 21.

The upper duct 370 may include an upper cover 373 configured to separate the storage compartment 21 and the second guide passage 371. The upper duct 370 may include a cooling discharge port 377 through which the cold air is discharged from the second guide passage 371 to the inside of the storage compartment 21 to cool the storage compartment 21. Therefore, according to the present embodiment of the present disclosure, the cold air may be discharged through the cooling discharge port 62 of the rear duct 60 and the cooling discharge port 377 of the upper duct 370 in a cooling mode of cooling the storage compartment 21, and thus cooling efficiency of the storage compartment 21 may be increased.

The upper duct 370 may include a partition 378 protruding from the upper cover 373 so that the cold air introduced into the second guide passage 371 moves toward the cooling discharge port 377.

A plurality of partitions 378 may be provided. For example, two partitions 378 may be provided on both left and right sides, and the second guide passage 371 may be divided into a center 371*a* into which the cold air is introduced from the first guide passage 61, a left side 371*b* formed on the left side of the center 371*a*, and a right side 371*c* provided on the right side of the center 371*a*.

The cooling discharge port 377 may be provided on at least one of the left side 371*b* and the right side 371*c*. The cold air introduced into the second guide passage 371 may be discharged to the cooling discharge port 377 by passing around the partition 378. Therefore, a flow in which the cold air introduced into the second guide passage 371 is discharged to the cooling discharge port 377 should pass around the partition 378, and thus the cold air introduced into the second guide passage 371 may face a passage resistance greater than that of a flow in which the cold air introduced into the second guide passage 371 is discharged to the air curtain discharge port 72.

Consequentially, in an air curtain mode in which the blade 90 closes the air curtain discharge port 72 and the blower fan 6 is operated, the discharge amount of cold air discharged to the cooling discharge port 377 may be minimized, and the discharge amount of cold air discharged to the air curtain discharge port 72 may be maximized.

As is apparent from the above description, an air curtain can be simply implemented with a blade attached to an air curtain discharge port without a separate fan or damper.

The refrigerator can increase an effect of an air curtain by increasing the discharge amount of cold air discharged to an air curtain discharge port.

The refrigerator can easily provide an option whether to form air curtain or not by adding or removing only an upper duct including an air curtain discharge port.

The spirit and scope of the disclosure are described by specific embodiments, but the scope of the present disclosure is not limited to the above-described specific embodiments. Various other embodiments that may be changed or modified by those skilled in the art without departing from the scope and spirit of the present disclosure defined by the appended claims fall within the scope of the present disclosure.

Although the present disclosure has been described with an exemplary embodiment, various changes and modifications may be suggested to one skilled in the art. It is intended that the present disclosure encompass such changes and modifications as fall within the scope of the appended claims.

DESCRIPTION OF SYMBOLS

1: REFRIGERATOR
2: COMPRESSOR
3, 4: EVAPORATOR
5: EVAPORATOR COVER
6, 7: BLOWER FAN
8: FAN CASE
9: FAN CASE OUTLET
10: MAIN BODY
21, 22, 23: STORAGE COMPARTMENT
30: DOOR
50: GUIDE DUCT
60: REAR DUCT
61: FIRST GUIDE PASSAGE
62: COOLING DISCHARGE PORT
63: REAR COVER
64: FIRST GUIDE WALLS
70: UPPER DUCT
71: SECOND GUIDE PASSAGE

72: AIR CURTAIN DISCHARGE PORT
73: UPPER COVER
74: SECOND GUIDE WALLS
90: BLADE
250: GUIDE DUCT
251: AIR CURTAIN PASSAGE
252: COOLING PASSAGE
253: BRANCHED POINT
350: GUIDE DUCT
371: SECOND GUIDE PASSAGE
372: AIR CURTAIN DISCHARGE PORT
378: PARTITION

What is claimed is:

1. A refrigerator comprising:
a main body;
a storage compartment formed in the main body and having an open front side;
a door provided to open and close the storage compartment;
an evaporator provided to generate cold air;
a rear duct including a first guide passage configured to guide the cold air generated in the evaporator and a cooling discharge port through which the cold air is discharged from the first guide passage to an inside of the storage compartment to cool the storage compartment;
an upper duct including a second guide passage coupled with the first guide passage and an air curtain discharge port through which the cold air is discharged from the second guide passage to a front opening of the storage compartment to form an air curtain at the front opening of the storage compartment; and
a blade provided to close or open the air curtain discharge port.

2. The refrigerator according to claim 1, further comprising a blower fan configured to suck the cold air generated in the evaporator, to discharge the cold air through the cooling discharge port when the air curtain discharge port is closed, and to discharge the cold air through the air curtain discharge port when the air curtain discharge port is opened.

3. The refrigerator according to claim 2, wherein:
the blower fan rotates at a first speed in a storage compartment cooling mode in which the blade closes the air curtain discharge port and the blower fan rotates; and
the blower fan rotates at a second speed faster than the first speed in an air curtain mode in which the blade opens the air curtain discharge port and the blower fan rotates.

4. The refrigerator according to claim 1, wherein a cross-sectional area of an outlet of the first guide passage is greater than a cross-sectional area of an inlet of the first guide passage.

5. The refrigerator according to claim 1, wherein the first guide passage has a section in which a cross-sectional area increases from an inlet of the first guide passage toward an outlet of the first guide passage.

6. The refrigerator according to claim 1, wherein the rear duct includes:
a rear cover configured to separate the storage compartment and the first guide passage; and
a pair of first guide walls provided to protrude from the rear cover and face each other to form the first guide passage.

7. The refrigerator according to claim 6, wherein a gap between the pair of first guide walls at an outlet of the first guide passage is greater than a gap between the pair of first guide walls at an inlet of the first guide passage.

8. The refrigerator according to claim 6, wherein the first guide passage has a section in which a gap between the pair of first guide walls increases from an inlet of the first guide passage toward an outlet of the first guide passage.

9. The refrigerator according to claim 1, wherein a cross-sectional area of an outlet of the second guide passage is greater than a cross-sectional area of an inlet of the second guide passage.

10. The refrigerator according to claim 1, wherein the second guide passage has a section in which a cross-sectional area increases from an inlet of the second guide passage toward an outlet of the second guide passage.

11. The refrigerator according to claim 1, wherein the upper duct includes:
an upper cover configured to separate the storage compartment and the second guide passage; and
a pair of second guide walls provided to protrude from the upper cover and face each other to form the second guide passage.

12. The refrigerator according to claim 11, wherein a gap between the pair of second guide walls at an outlet of the second guide passage is greater than a gap between the pair of second guide walls at an inlet of the second guide passage.

13. The refrigerator according to claim 11, wherein the second guide passage has a section in which a gap between the pair of second guide walls increases from an inlet of the second guide passage toward an outlet of the second guide passage.

14. The refrigerator according to claim 1, wherein:
the rear duct and the upper duct are separately provided; and
the rear duct and the upper duct have couplers provided to be coupled to each other.

15. The refrigerator according to claim 1, wherein the blade is configured to rotatably guide the cold air discharged through the air curtain discharge port to a rear surface of the door when the door is closed.

16. A refrigerator comprising:
a main body;
a storage compartment formed in the main body and having an open front side;
a door provided to open and close the storage compartment;
an evaporator provided to generate cold air;
a guide duct including an air curtain discharge port through which the cold air is discharged to a front opening of the storage compartment to form an air curtain at the front opening of the storage compartment, a cooling discharge port through which the cold air is discharged to the inside of the storage compartment to cool the storage compartment, an air curtain passage configured to guide the cold air generated in the evaporator to the air curtain discharge port, and a cooling passage branched from the air curtain passage to guide the cold air generated in the evaporator to the cooling discharge port; and
a blade provided to close or open the air curtain discharge port.

17. The refrigerator according to claim 16, wherein a passage resistance of the air curtain passage is less than a passage resistance of the cooing cooling passage.

18. The refrigerator according to claim 16, wherein the guide duct includes:

a rear duct including the cooling discharge port and coupled to a rear surface of the storage compartment; and an upper duct including an air curtain discharge port and coupled to an upper surface of the storage compartment.

19. A refrigerator comprising:

a main body;

a storage compartment formed in the main body and having an open front side;

a door provided to close and open the storage compartment;

an evaporator provided to generate cold air;

a guide duct including a guide passage configured to guide the cold air generated in the evaporator, an air curtain discharge port through which the cold air is discharged from the guide passage to a front opening of the storage compartment to form an air curtain at the front opening of the storage compartment, a cooling discharge port through which the cold air is discharged from the guide passage to the inside of the storage compartment to cool the storage compartment, a cover configured to separate the storage compartment and the guide passage, and a partition configured to protrude from the cover so that the cold air introduced into the guide passage moves toward the cooling discharge port; and a blade provided to close or open the air curtain discharge port.

20. The refrigerator according to claim 19, wherein:

a plurality of partitions are provided;

the guide passage is divided into a center, a left side and a right side by the plurality of partitions; and cooling discharge ports are provided on the left side and the right side.

* * * * *